US005716752A

United States Patent [19]

Ott et al.

[11] Patent Number: 5,716,752

[45] Date of Patent: Feb. 10, 1998

[54] METHOD OF MAKING TONER COMPOSITIONS

[75] Inventors: Mary L. Ott, Fairport; Pinyen Lin; Samir Kumar, both of Rochester; Scott M. Silence, Fairport, all of N.Y.

[73] Assignee: Xerox Corporation, Stamford, Conn.

[21] Appl. No.: 843,883

[22] Filed: Apr. 17, 1997

[51] Int. Cl.[6] ..... G03G 9/08; G03G 9/083

[52] U.S. Cl. ..... 430/137

[58] Field of Search ..... 430/137

[56] References Cited

U.S. PATENT DOCUMENTS

| | | | |
|---|---|---|---|
| Re. 33,172 | 2/1990 | Gruber et al. | 430/39 |
| 3,590,000 | 6/1971 | Palermiti et al. . | |
| 3,893,935 | 7/1975 | Jadwin et al. . | |
| 3,900,588 | 8/1975 | Fisher . | |
| 4,078,929 | 3/1978 | Gundlach . | |
| 4,221,856 | 9/1980 | Lu | 430/110 |
| 4,265,990 | 5/1981 | Stolka et al. | 430/59 |
| 4,291,111 | 9/1981 | Lu | 430/107 |
| 4,291,112 | 9/1981 | Lu | 430/110 |
| 4,298,672 | 11/1981 | Lu | 430/108 |
| 4,338,390 | 7/1982 | Lu | 430/106 |
| 4,935,326 | 6/1990 | Creatura et al. | 430/108 |
| 4,937,166 | 6/1990 | Creatura et al. | 430/108 |
| 5,510,221 | 4/1996 | Matalevich et al. | 430/106.6 |
| 5,552,252 | 9/1996 | Lundy et al. | 430/39 |

*Primary Examiner*—Roland Martin
*Attorney, Agent, or Firm*—E. O. Palazzo

[57] ABSTRACT

A process for decreasing toner adhesion and decreasing toner cohesion, which comprises adding a component of magnetite, a metal, a metal oxide, a metal carbide, or a metal nitride to the surface of a toner comprised of resin, wax, and colorant, and wherein toner surface additives are blended with said toner, and wherein said component is permanently attached to the toner surface by the injection of said component in a fluid bed milling device during the size reduction process of said toner contained in said device, and where the power imparted to the toner to obtain said attachment is from equal to, or about above 5 watts per gram of toner.

24 Claims, 2 Drawing Sheets

METHOD OF MAKING TONER COMPOSITIONS

PENDING APPLICATIONS

There are illustrated in copending application U.S. Ser. No. 08/842,924, filed concurrently herewith, the disclosure of which is totally incorporated herein by reference, toners with spacers, such as magnetites.

BACKGROUND OF THE INVENTION

This invention is generally directed to black toner and developer compositions, and more specifically, the present invention is directed to developer and toner compositions containing large external additives, or very large external additives (VLA), such as magnetites, and which additives function to eliminate, or minimize development falloff characteristics, and wherein the additives are present on the toner surface and function as spacers between the toner and carrier particles thereby reducing the impaction of small conventional toner surface additives of, for example, a size of from about 8 to about 20 nanometers, such as silicas and titanias during aging in the development housing. More specifically, the present invention relates to processes for decreasing toner adhesion and toner cohesion, and reducing toner aging, that is the adhesivity and cohesivity increase of the toner with time in the development housing, and wherein lesser amounts and smaller size additives, for example from about 8 to about 20 nanometers, and which smaller additives include colloidal or fumed silicas and titanias. Therefore, in embodiments, the use of the aforementioned large toner surface additives, for example 40 nanometers, of fumed silica and titania can be avoided. The invention in embodiments relates to the continuous injection of very large additives, for example from about 100 nanometers to about 500 nanometers, and preferably from about 100 to about 200 nanometers, such as additives of magnetites, in an amount, for example, of less than or equal to about 12 weight percent, and more specifically, from about 1 to about 12 weight percent, and preferably from about 3 to about 9 weight percent, to primarily increase the stability of black developers against disadvantageous burial of functional small-size toner additives by the development housing during the imaging process in the development system. The very large additives, such as magnetite, primarily function as a spacer-type barrier, therefore, the smaller, from about 8 to about 20 nanometers in diameter, functional toner additives of, for example, silica and titania are shielded from contact forces that embed them in the toner surface. The invention in embodiments is directed to a toner which evidences aging instability, that is an increase in toner cohesion and adhesion with energy, with small sized, from about 8 to about 20 nanometers, external toner additives in energetic environments, and which instability results in a substantial decrease in both the developed and transferred mass per unit area on a photoreceptor in a xerographic environment under, for example, the conditions of low area coverage document printing or copying. Disclosed is a developer wherein the toner possesses a small, less than about 12 percent by weight, amount of tightly bound low-cost very large additives, for example from about 100 to about 500 nanometers, $d_{50}$=200 nanometers, such as magnetite, together with small sized conventional toner surface additives, and wherein the VLA provides a barrier and minimizes the burial of small-sized toner surface additives, thereby rendering a developer with improved flow stability and hence excellent development and transfer stability during copying/printing in xerographic imaging processes under the conditions of low toner area coverage of a page, for example when less than 3 percent of the area of a document has toner applied to the surface. The toner compositions of the present invention in embodiments thereof maintain their DMA (developed mass per area on a photoreceptor), their TMA (transferred mass per area of a photoreceptor) and acceptable triboelectric charging characteristics for an extended number of imaging cycles. The toner and developer compositions of the present invention can be selected for electrophotographic, especially xerographic, imaging and printing processes, including digital processes.

Toner cohesion refers to toner particles adhering to each other, and toner adhesion refers to toner particles adhering to a donor roll. Both these disadvantages are avoided or minimized with the processes of the present invention.

PRIOR ART

Black toners with magnetites incorporated therein as pigments are known, reference for example U.S. Reissue Pat. Re. 33, 172 relating to MICR toners. Black toners with magnetites incorporated onto the toner are also known, see for example U.S. Pat. Nos. 5,510,221 and 5,552,252, the disclosures of which are totally incorporated herein by reference. In these patents, however, magnetite is gently added to the toner surface so that during aging it will detach from the toner surface and remain on the photoreceptor surface, thereby acting as a photoreceptor filming agent and lubricant to prevent comet formation. With the present invention, the magnetite remains on the toner surface throughout the lifetime of the toner, thereby acting as a spacer to prevent aging induced additive impaction and the associated toner adhesion and cohesion increases, a slowing of the impaction aging process from an adhesion/cohesion perspective as well as from a tribo decay perspective for magnetite treated toners versus nontreated toners.

Also known are developer compositions with charge enhancing additives, which impart charge to the toner resin. Thus, for example, there is described in U.S. Pat. No. 3,893,935 the use of quaternary ammonium salts as charge control agents for electrostatic toner compositions. In this patent, there are disclosed toners, quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchloride, tetrafluoroborate, benzene sulfonate, and the like; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933, which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica. Also, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. No. Pat. Nos. 3,944,493; 4,007,293; 4,079,014; 4,394,430, and 4,560,635 which illustrates a toner with a distearyl dimethyl ammonium methyl sulfate charge additive.

Although many toners are known, there continues to be a need for toners and processes, which possess many of the advantages illustrated herein. Moreover, there continues to be a need for black toner compositions that are useful for incorporation into various imaging processes, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for toner compositions which have the desired triboelectric charge level, for example, from about 10 to about 40 microcoulombs per gram, and preferably from about −10 to about −25 microcoulombs per gram, and admix charging rates of from about 5 to about 60 seconds, and preferably from about 15 to about 30 seconds, as determined by the charge spectrograph, and which toners possess improved toner aging, and excellent toner powder flow stability (desirable adhesion and cohesion characteristics with aging in xerographic developer environments).

SUMMARY OF THE INVENTION

It is an object of the present invention to provide toner and developer compositions with many of the advantages illustrated herein.

In another object of the present invention there are provided negatively charged toner compositions useful for the development of electrostatic latent images.

In yet another object of the present invention there are provided processes for decreasing toner adhesion and toner cohesion, and minimizing or eliminating toner aging.

Also, in another object of the present invention there are provided processes and compositions wherein the size of the toner surface additives, such as silicas and titanias, can be reduced from additive diameters of about 40 nanometers or greater to additive diameters of about 20 nanometers or less, for example from about 7 to about 15, and the amount of surface additives selected can be reduced from greater than about 6 percent by weight of the toner to less than about 2 percent, and specifically from about 0.05 to about 1.5 weight percent, by weight of the toner.

In yet a further object of the present invention there are provided toners with acceptable triboelectric charging characteristics of from about −10 to about −40 microcoulombs per gram against, for example, a particular carrier comprised of a core, preferably an irregularly shaped steel core with a diameter of between 50 and 125 micrometers, and a coating polymer, such as poly(methylmethacrylate), polystyrene, or poly(urethane), which coating may optionally contain a conductive additive, such as conductive carbon black or tin oxide, in sufficient quantity to render the carrier conductive, and which toners exhibit minimal variations in xerographic development subsystem environments.

Another object of the present invention resides in the formation of toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is those exceeding 100 copies per minute.

BRIEF DESCRIPTION OF THE FIGURES

Illustrated in FIGS. 1 to 4 are graphs evidencing the improved characteristics of the toner and processes of the present invention.

INVENTION EMBODIMENTS

Figure 1:
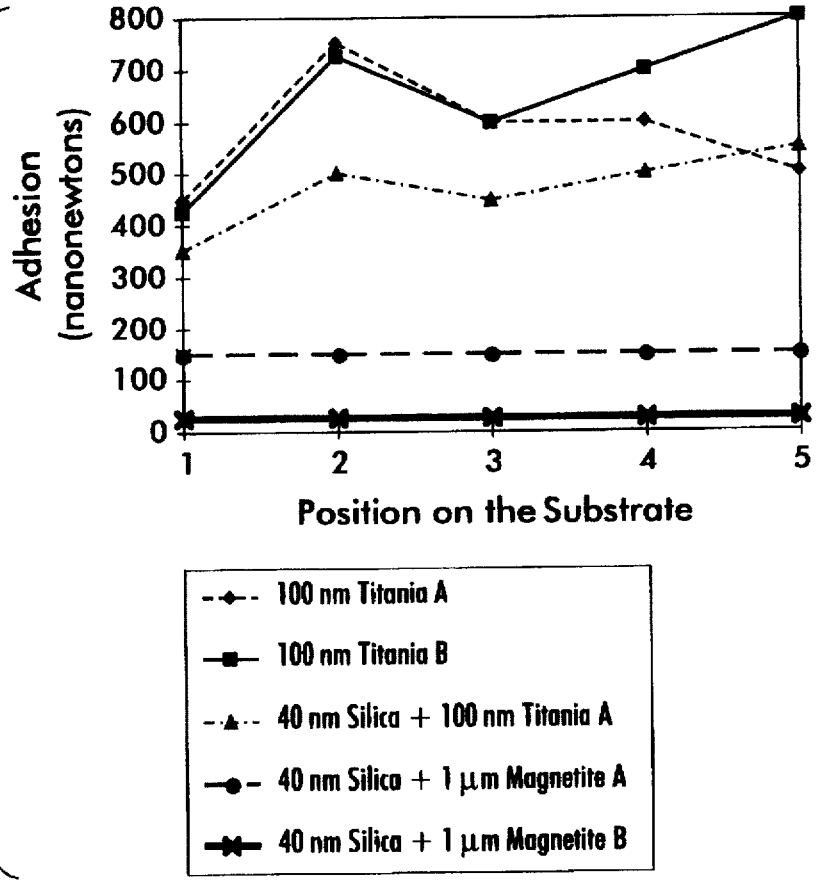

In embodiments thereof, the present invention relates to providing toners and developers thereof with the advantages illustrated herein. More specifically, the present invention in embodiments is directed to processes wherein there are added to the toner surface spacer components of, for example, magnetites. These components are added to the toner surface in various effective amounts, such as from about less than about 1 weight percent to about 12 weight percent, and more specifically, preferably from about 3 weight percent to about 9 weight percent.

The toner compositions of the present invention can be prepared by a number of methods, such as melt mixing and heating resin particles such as a crosslinked polyester with about 37 to about 40 percent toluene insoluble, pigment particles, such as carbon black like REGAL 330®, wax, such as Sanyo 660P polypropylene wax, and compatibilizer, such as Elf AtoChem AX8840, a block copolymer of ethylene-diglycidyl methacrylate in a toner extrusion device, such as the ZSK40 available from Werner Pfleiderer, and removing the formed toner composition from the device.

Subsequent to cooling, the toner composition is subjected to grinding utilizing, for example, an Alpine Fluid Bed Grinder (AFG) for the purpose of achieving toner particles with a volume median diameter of less than about 25 microns, and preferably of from about 8 to about 12 microns, which diameters are determined by a Coulter Counter. The very large magnetite additives are continuously injected at a given rate during the toner size reduction process to enable a desired weight percent magnetite, for example from about 3 to about 9 percent by weight in the ground product, and which magnetite is permanently attached to the toner surface. For example, for a 200AFG grinder with a toner grind rate of 14 pounds per hour, the magnetite injection rate is from about 0.6 pound per hour to about 1.8 pounds per hour. The very large additives, such as magnetite, can be injected alone or with a flow aid, such as Cabosil Fumed Silica TS-530 or Tayca MT3103 Titania, as a mixture to ease the feeding and handling of magnetites. The magnetite can be premixed with fumed silica or titania at various effective ratios, such as 30:1. The magnetite and silica or titania mixture is continuously injected to the AFG grind chamber by a pneumatic solids conveying system. The magnetite/silica or magnetite/titania mixture is continuously fed to the funnel at a desired rate of, for example, from about 0.6 pound per hour to about 1.8 pounds per hour for a toner grind rate of 14 pounds per hour using a Merrick Groove Disk feeder (22-01). The FOX venturi eductor provides a suction high enough at the feed funnel to entrain the magnetite/silica or magnetite/titania mixture in the air stream. The entrained mixture is accelerated and conveyed through the discharge pipe to the grind chamber. The entry to the grind chamber through the feed port is tangential, which provides sufficient opportunity for the dispersed additive (magnetite and silica or titania) to contact the large toner particles flowing down along the wall. The magnetite together with silica or titania additive is disintegrated to primary aggregate size range due to the jetting effect in the grinding zone. This allows for a rapid access of primary size additive aggregates to the virgin surface of individual toner particles which are continuously formed due to jetting. It has been shown from scanning electron microscopy that the magnetite becomes firmly attached to the toner surface due to the inherent mixing pattern in the fluid bed grinders.

With further reference to the prior art, additives are blended onto the toner surface in a Henschel-type blender after size reduction and size-based classification processes in the toner production process are completed. The process of continuous injection of VLA (such as magnetite) at grinding is of high importance to the process of the present invention. Continuous injection of VLA at grinding enables formation of a tightly bound, uniform coverage of the VLA on the toner surface due primarily to intense distributive and dispersive mixing in the fluid bed grinding zone. For example, typical additive blending processes using a Henschel-type blender impart a specific power of less than about 0.7 watt per gram of toner to the toner, whereas in the, process of the present invention there is selected a specific power of at least about 5 watts, and more specifically, from about 10 to 15 watts per gram of toner to the toner.

Subsequently, the toner compositions can be classified utilizing, for example, a Donaldson Model B classifier for the purpose of removing fines, that is toner particles less than about 4 microns volume median diameter. There is also removed free/loosely attached magnetite as fines. Subsequent to classification, the toner is blended with conventional small-sized (low cost) known external additives, such as silica and titania, in Henschel FM-10 blender.

External additives on toner surfaces primarily influence toner xerographic performance, such as toner tribo and a toner's ability to flow properly. Additive presence on a toner surface may increase toner tribo or suppress toner tribo depending, for example, on the toner resin and toner additive selected. A toner with a very low triboelectric value, for example less than 8 microcoulombs per gram, is very difficult to control xerographically, while a toner with very high tribo, for example greater than about 40 microcoulombs per gram, is difficult to release from the carrier. Therefore, stable tribo in a xerographically appropriate range is desirable. Further, in powder cloud development systems, such as Hybrid Jumping Development, an acceptable level of toner flow (cohesion and adhesion) is desired throughout the imaging process; for example, a toner cohesion in the range of from about 10 percent to about 65 percent measured using a standard process on a Hosokawa powder tester (Hosokawa Powder Micron Systems, Inc.) is desired throughout the imaging process. Xerographic development in these systems is believed to involve individual toner particles jumping back and forth between roll surfaces and photoreceptor surfaces multiple times, some initiating cascade effects for others. Thus, the adhesion of toner to the roll/photoreceptor, and the cohesion of toner particles to each other as a function of toner residence time in development housing is to be maintained at an acceptable, or suitable level. As one consequence, additive present on the toner surface should be stable to minimize changes in the state of the toner with variation in solid area coverage. In a developer housing, carrier beads collide with toners and the force from the collision tends to drive the external additives into the toner surface. As the additives are impacted into the toner surface with time, toner tribo and toner flowability will usually change. In an aggressive development housing, toner flowability degrades rapidly, for example with a toner cohesion increasing from a value of less than 15 percent to a value of greater than 75 percent under conditions of low toner area coverage of a document, during either xerographic copying or printing, in a period of less than 1,500 prints that are generated in a xerographic imaging system. The increase in cohesion of toner particles and adhesion to the donor roll, beyond an acceptable threshold level of about 65 percent toner cohesion, leads to loss of development. With the present invention in embodiments thereof, there is provided a toner surface that withstands the impact of the carrier bead collisions and prevents or limits toner surface additive impaction.

Evidence that the use of magnetite as a hard spacer provides advantages through adhesion measurements, such as is further illustrated with reference to FIGS. 1 to 4.

In the FIG. 1 experiments, toners with different surface additives are contacted to five different positions on a flat photoconductive substrate, and more specifically, a photoconductive member comprised of a supporting substrate, a photogenerating layer, and an aryl amine hole transport layer with aryl amine molecules dispersed in a polycarbonate resin binder, reference U.S. Pat. No. 4,265,990 wherein such photoconductive members are illustrated, the disclosure of this patent being totally incorporated herein by reference, and the force required to break the toner-surface contact is measured. The data illustrates toners with titanias alone or titanias in combination with silicas as external additives show high adhesions (350 nanonewtons (nnt) to 800 nanonewtons as measured with an Atomic Force Microscope) to a flat substrate. Adding magnetite to the surface of the toner prohibits intimate contact of the toner surface with the flat substrate and decreases adhesion substantially to values of 25 nanonewtons or 150 nanonewtons. With the toners of the present invention, the toner adhesion decreases as shown in FIG. 1.

Figure 2:
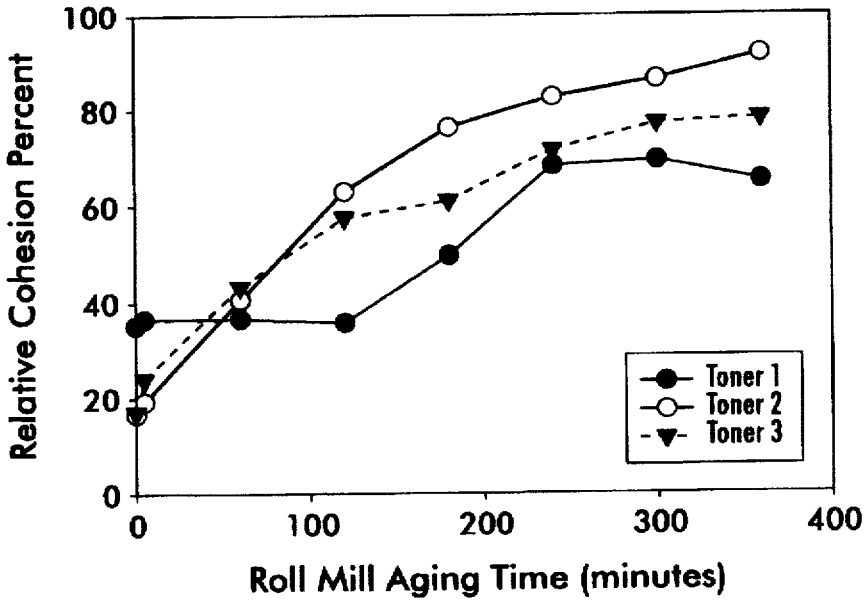

In FIG. 2 there is illustrated the extent of aging induced additive impaction on a toner surface which is inferred from a measurement of toner cohesion in a Hosokawa Powder Cohesion Tester (Hosokawa Micron, Inc.). Under standard test conditions using screens with 38, 45 and 53 micron screen openings and a vibration amplitude of 1 millimeter for a duration of 90 seconds, typical unaged toner cohesions range from 15 percent to 35 percent (on a scale of 0 percent to 100 percent with 100 percent indicating no flowability) depending on the external additive package. Aging in a housing for one hour can increase cohesions to 60 to 90 percent, depending on the external additive package. This housing aging is simulated on bench by a roll mill technique wherein toners are rolled in a glass jar with steel balls. 360 Minutes of roll milling with steel balls provides aging equivalent to 60 minutes of collisions with carrier beads in a xerographic development environment. Toner 1 has large silicas and large titanias (40 nanometers) on the surface. Toner 2 has small silicas (8 nanometers) and small titanias (16 to 20 nanometers) on the surface. Large silicas and large titanias decrease the aging process as evidenced by the slower increase in toner cohesion. Toner 3 has the same external additive set as toner 1 with magnetite added to the surface at 4 percent loading by weight (as determined by chemical analysis). The magnetite is effectively acting as a spacer to slow down the impaction of the small additives into the toner surface.

Figure 3:
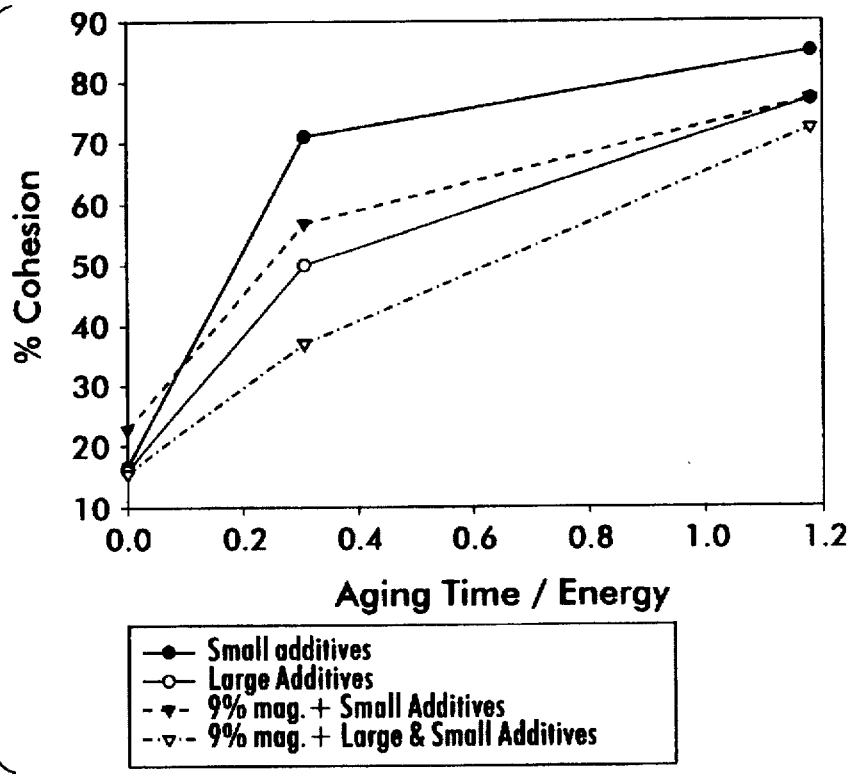

In another example of flow stability with respect to mechanical aging at bench is shown by Hybridizer Mechanical Aging Protocol, reference FIG. 3. The blended (unaged) toner is subjected to an energetic environment by an intensive surface processing device (NHSO Hybridizer, Nara Corporation) and the cohesion of toner is measured afterward. FIG. 3 illustrates the percent cohesion rise with respect to aging time/energy for small additive package and large additive package. The toner with large additives is more stable with respect to mechanical aging than the toner with small sized additives. The magnetite on the toner surface and the small additives improved flow stability over the use of small additives alone. Introducing 50 percent large additives and 50 percent small additives on magnetite based toner renders its flow stability superior to large additive toner.

Figure 4:
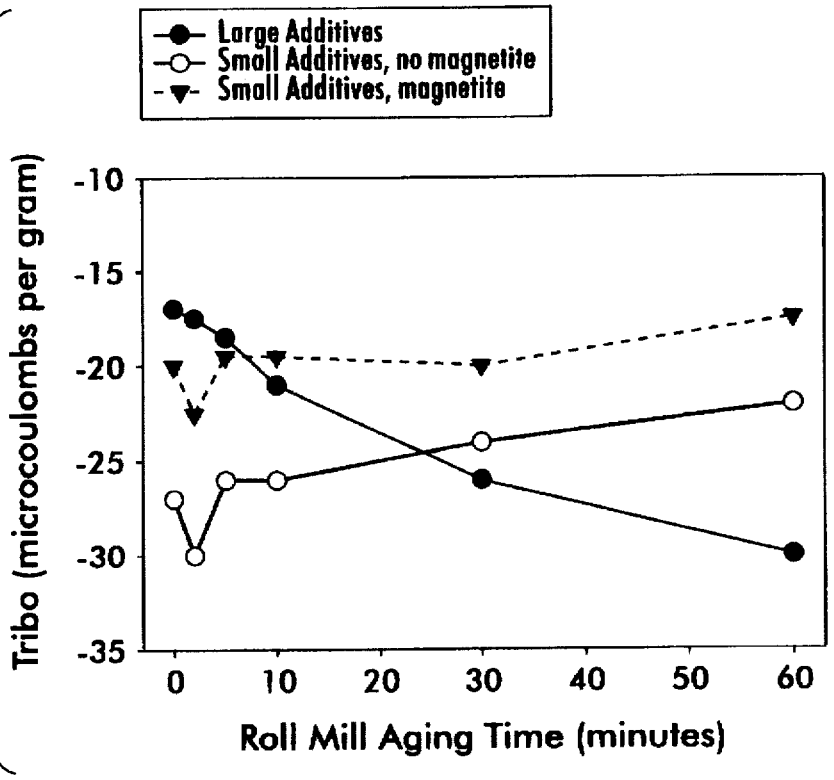

The effect of magnetite on the triboelectric charge of the toner is illustrated in the FIG. 4. With small external additives and without magnetite on the toner surface, the triboelectric value of the unaged toner is −27 microcoulombs per gram. With the same external additive set and with the presence of magnetite on the toner surface, the triboelectric value of the toner is −20 microcoulombs per gram. With larger external additives, and in the absence of surface magnetite on the toner, the triboelectric value of the toner is −17 microcoulombs per gram. With 60 minutes of roll mill aging, the large additive toner tribo increases to −30 microcoulombs per gram, while the tribo of the toner with small external additives, with or without surface magnetite, decreases. For the toner without magnetite, the tribo after 60 minutes of roll mill aging is −24 microcoulombs per gram, and for the toner with magnetite, the tribo after 60 minutes of roll mill aging is −18 microcoulombs per gram.

With further reference to FIG. 1, there were selected 100 nanometers of Titania A=2 weight percent 100 nanometers Titania STT100J (Titan Kogyo); 100 nanometers of Titania B=2 weight percent Titania W1 (Mitsubishi Metal Powders); 40 nanometers of silica plus 100 nanometers of Titania A=1 weight percent 40 nanometers silica, 1 weight percent 100 nanometers Titania STT100J; 40 nanometers silica plus 1 micron of Magnetite A=1 weight percent 40 nanometers silica, 1 weight percent MAPICO BLACK™ magnetite; and 40 nanometers silica plus 1 micron of Magnetite B=1 weight percent 40 nanometers silica, 1 weight percent Toda Kogyo magnetite.

FIG. 2-Toner 1 has external additives of 2.5 weight percent (40 nanometers silica), 3.6 weight percent SMT5103 (40 nanometers titania), and 0.2 percent ZnSt. Toner 2 has 0.6 weight percent TS-530 (8 nanometers silica), 0.8 weight percent (16 nanometers titania), 1.0 weight percent P25 (25 nanometers titania), and 0.2 percent by weight zinc stearate. Toner 3 has the same additive package as Toner 2, but applied over a surface on which 4 weight percent magnetite has been coated by the process illustrated herein.

FIG. 3-Small Additives is Toner 2 from FIG. 2; Large Additives is Toner 1 from FIG. 2, 9 percent magnetite plus Small Additives is the same small additive package, but applied over a surface on which 9 weight percent magnetite has been coated, and 9 percent magnetite plus Large and Small Additives is 1.3 weight percent (40 nanometers silica), 1.8 weight percent SMT5103 (40 nanometers titania), 0.3 weight percent TS-530 (8 nanometers silica), 0.4 weight percent (16 nanometers titania), 0.5 weight percent P25 (25 nanometers titania), and 0.2 percent by weight zinc stearate, applied over a surface on which 9 weight percent magnetite has been put on by the process covered in the patent.

FIG. 4-Large Additives is Toner 1 from FIG. 2; Small Additives, no magnetite is Toner 2 from FIG. 2, and Small Additives, magnetite is 9 percent magnetite plus the Small Additives from FIG. 3.

Illustrative examples of suitable toner resins selected for the toner and developer compositions of the present invention include polyamides, polyolefins, styrene acrylates, styrene methacrylate, styrene butadienes, polyesters, especially reactive extruded polyesters, crosslinked styrene polymers, epoxies, polyurethanes, vinyl resins, including homopolymers or copolymers of two or more vinyl monomers; and polymeric lo esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, styrene butadiene copolymers; with a styrene content of from about 70 to about 95 weight percent, reference the U.S. patents mentioned herein, the disclosures of which have been totally incorporated herein by reference. In addition crosslinked resins, including polymers, copolymers, homopolymers of the aforementioned styrene polymers may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; Pliolites; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, reactive extruded polyesters, especially those with a gel amount of about 30 percent, reference U.S. Pat. Nos. 5,376,494 and 5,227,460, the disclosure of which is totally incorporated herein by reference, styrene acrylates, and mixtures thereof. Also, waxes with a molecular weight of from about 1,000 to about 20,000 such as polyethylene, polypropylene, and paraffin waxes can be included in, or on the toner compositions as fuser roll release agents.

The resin particles are present in a sufficient, but effective amount, for example from about 70 to about 90 weight percent. Thus, when 1 percent by weight of the charge enhancing additive is present, and 10 percent by weight of pigment or colorant, such as carbon black, and the like is contained therein, about 89 percent by weight of resin is selected.

Numerous well known suitable colorants, such as pigments or dyes, can be selected as the colorant for the toner particles including, for example, carbon black, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 3 to about 10 weight percent based on the total weight of the toner composition; however, lesser or greater amounts of pigment particles can be selected.

When the pigment particles are comprised of magnetites, thereby enabling single component toners in some instances, which magnetites are a mixture of iron oxides ($FeOFe_2O_3$) including those commercially available as MAPICO BLACK™, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK™, in an amount of, for example, from about 5 to about 60, and preferably from about 10 to about 50 weight percent can be selected. The aforementioned magnetites can be selected as the spacer component, and preferably the magnetite is not included in the toner as a pigment.

There can also be blended with the toner compositions of the present invention external surface additive particles, including flow aid additives, which additives are usually present on the surface thereof. Examples of these additives include colloidal silicas such as AEROSIL®, metal salts and metal salts of fatty acids inclusive of zinc stearate, metal oxides such as aluminum oxides, cerium oxides, titanium dioxides (titania), and mixtures thereof, and wherein the total amount of the additives selected are for example, from about 0.1 percent by weight to about 5 percent by weight, and preferably from about 0.1 percent by weight to about 1 percent by weight. Several of the aforementioned additives are illustrated in U.S. Pat. Nos. 3,590,000 and 3,900,588, the disclosures of which are totally incorporated herein by reference.

Also, there can be included in the toner compositions of the present invention low molecular weight waxes, such as polypropylenes and polyethylenes commercially available from Allied Chemical and Petrolite Corporation, EPOLENE N-15 commercially available from Eastman Chemical Products, Inc., VISCOL 550-P, a low weight average molecular weight polypropylene available from Sanyo Kasei K. K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Pat. No. No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Examples of compatibilizers that may optionally be included in the toner to primarily retain the wax therein include block or graft copolymers of the structures A-(block)-B, A-b-B-b-A or A-(graft)-B with the polymeric segments A and B each being compatible with a different polymer thereby -0 permitting the compatibilizer to serve, for example, as a macromolecular surfactant. Examples of compatibilizers include block copolymers, such as the KRATON® copolymers, available from Shell Chemical Company, and STEREON® copolymers, available from Firestone Tire and Rubber Company. For example, KRATON G1701X®, a block copolymer of styrene-ethylene/propylene, KRATON G1726X®, a block copolymer of styrene-ethylene/butylene-styrene, KRATON G1652®, a block copolymer of styrene-ethylene/butylene-styrene, STEREON 730A®, a block copolymer of styrene-and butadiene, and the like are suitable for improving the wax dispersion in styrenic resins. With KRATON G1701X®, the A segment could be the styrene block and the B segment could be an ethylene/propylene block. In embodiments of U.S. Pat. No. 5,229,242, there are provided toners wherein the compatibilizer is of the formulas A-b-B, A-b-B, or A-g-B wherein A-b-B is a block copolymer of 2 segments, A and B, A-b-B-b-A is a block copolymer of 3-segments, A, B and A, and A-g-B is a graft copolymer of segments A and B, wherein the polymeric segment A is identical or compatible to one of the components present in the toner composition, that is the toner resin, whereas the polymeric segment B is identical or compatible with the other polymer component in the toner composition, that is, for example, the wax. Thus, the aforementioned compatibilizer can be comprised of rigid units, such as styrene, with the polymeric segment B being comprised of flexible, rubber-like units, such as ethylene/propylene. The molecular weight of polymeric segment A can be from about 3,000 to about 100,000, and the molecular weight of polymeric segment B can be from about 5,000 to about 200,000. The compatibilizer is present in various effective amounts, such as, for example, from about 0.5 to about 9 percent, and preferably from about 1 to about 5 weight percent in embodiments.

Encompassed within the scope of the present invention are black toner and developer compositions comprised of toner resin particles, optional carrier particles, the charge enhancing additives illustrated herein, and as pigments or colorants carbon black and magnetite particles, as well as mixtures thereof.

For the formulation of developer compositions, there are mixed with the toner particles carrier components, particularly those that are capable of triboelectrically assuming an opposite polarity to that of the toner composition. Accordingly, the carrier particles of the present invention are selected to be of a positive polarity enabling the toner particles, which are negatively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles is generally from about 30 microns to about 500, and preferably from about 50 to about 125 microns, thereby permitting them to possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier.

The toner and developer compositions of the present invention may be selected for use in electrostatographic imaging apparatuses containing therein conventional photoreceptors providing that they are capable of being charged positively. Thus, the toner and developer compositions of the present invention can be used with layered photoreceptors that are capable of being charged positively, reference U.S. Pat. No. 4,265,990, the disclosure of which is totally incorporated herein by reference. Illustrative examples of inorganic photoreceptors that may be selected for imaging and printing processes include AMAT. Other similar photoreceptors can be selected providing the objectives of the present invention are achievable.

With further respect to the present invention, one developer composition is comprised of 5 parts by weight of a toner and 95 parts by weight of a carrier. The toner is comprised of 87 percent by weight of a crosslinked polyester resin, 5 percent by weight of carbon black, 4 percent by weight of a polypropylene wax, and 4 percent by weight of a compatibilizing agent comprised of KRATON™ obtained from Shell Chemicals; onto the surface of the toner 4 percent magnetite has been attached, followed by 0.6 percent of an 8 nanometer silica external additive, 0.8 percent of a 16 nanometer titania, and 1.0 percent of a 25 nanometer titania. The carrier is comprised of 99 percent by weight of an irregularly shaped steel core coated with 1 percent by weight of a Conductex SC Ultra conductive carbon black/poly (methylmethacrylate) composite.

Embodiments of the present invention include a process for decreasing toner adhesion and decreasing toner cohesion, which comprises adding a component of magnetite, a metal, a metal oxide, a metal carbide, or a metal nitride to the surface of a toner comprised of resin, wax, optional compatibilizer, and colorant, and wherein toner surface additives are blended with the toner, and wherein the component is permanently attached to the toner surface by the injection of the component in a fluid bed milling device during the size reduction process of the toner contained in the device, and where the power imparted to the toner to obtain the attachment is from equal to, or about above 5 watts per gram of toner; a process wherein the component is magnetite, and is added in an amount of from about 1 to about 12 weight percent, the injection is continuous, and the colorant is a pigment; a process wherein the power is from about 6 to about 15 watts per gram of toner, the injection is continuous, and the colorant is a pigment; a process wherein the component is boron nitride, silicon carbide, silicon nitride, strontium titanate, tin oxide, barium titanate, magnesium titanate, barium zirconate, strontium zirconate, yttrium oxide, aluminum oxide, or aluminum nitride, and the toner surface additives are comprised of silica and titania; a process for decreasing toner adhesion and decreasing toner cohesion, which comprises adding a component of magnetite to the surface of a toner comprised of resin, compatibilizer, wax, and pigment, and wherein the magnetite is permanently attached to the toner surface by continuous injection of the magnetite additive in a fluid bed milling device during the size reduction process of the toner, and where the specific power imparted to the toner during the attachment process is equal to, or above about 5 watts per gram of toner; a process wherein the power is from about 10 to 15 watts per gram of toner, and the injection is continuous; a process wherein the magnetite is selected in an amount of from about 3 to about 9 weight percent; a process wherein the magnetite is selected in an amount of from about 6 to about 9 weight percent; a process wherein the toner further includes on the surface additives of silica, titania, and a zinc stearate film forming additive; a process wherein each of the additives is selected in an amount of from about 0.1 to about 1 weight percent; a process wherein the toner is substantially free of aging for about 500,000 imaging cycles in a xerographic imaging or printing apparatus; a process wherein the toner is substantially free of aging for about 500,000 imaging cycles in a xerographic imaging or printing apparatus; a process wherein the toner contains surface additives of silica and titanium oxide in an amount of from about 0.1 to about 0.75 weight percent; a process wherein the resin is a polyester; a process wherein the pigment is carbon black; a process wherein the carbon black is present in an amount of from about 2 to about 12 weight percent; a process which comprises adding a magnetite to a toner comprised of resin, colorant, wax, compatibilizer, and surface additives, and wherein the magnetite is permanently attached to the toner surface by the continuous injection of the magnetite in a fluid bed milling device during the size reduction process of the toner contained in the device, and where the power imparted to the toner during the attachment is at least about 5 watts per gram of toner; a process wherein the surface additives are comprised of fumed silica and metal oxides, each present in an amount of from about 0.1 to about 0.5 weight percent, the colorant is a pigment, and the power is from about 10 to about 15 watts; a process wherein the resin is a styrene acrylate, a styrene methacrylate, a styrene butadiene, or a polyester; the wax is of a low molecular weight of from about 1,000 to about 20,000; and the wax is present in an amount of from about 3 to about 10 weight percent; a process wherein the toner further contains a charge enhancing additive; a process wherein the resin is present in an amount of from about 75 to about 95 weight percent, the pigment is present in an amount of from about 2 to about 12 weight percent, the wax is present in an amount of from about 2 to about 5 weight percent, and the compatibilizer is present in an amount of from about 1 to about 5 weight percent; and wherein the total percent is about 100; a process wherein the toner is mixed with carrier particles; a process wherein the carrier contains a coating thereover of a polyvinylidine fluoride, a polymethyl methacrylate, or a mixture of polymers not in close proximity in the triboelectric series; and a process which comprises adding a component of magnetite, a metal, a metal oxide, a metal carbide, or a metal nitride to the surface of a toner comprised of resin, wax, and colorant, and wherein the component is permanently attached to the toner surface.

The following Examples are being supplied to further define various species of the present invention, it being noted that these Examples are intended to illustrate and not limit the scope of the present invention. Parts and percentages are by weight unless otherwise indicated.

EXAMPLE I

Black Developer Composition 1

There was prepared in an extrusion device, available as ZSK40 from Werner Pfleiderer, a toner composition by adding thereto 86 percent by weight of a crosslinked polyester resin (bisphenol A propylene oxide fumarate polymer with 33 to 40 percent gel), 5 percent by weight of 660 P Sanyo polypropylene wax; 5 percent by weight of REGAL 330® carbon black; and 4 percent of AX-8840 compatibilizer (a block copolymer of ethylene glycidyl methacrylate). The toner product, which was extruded at a rate of 200 pounds per hour, reached a melting temperature of 160° C. The strands of melt mixed product exiting from the extruder were cooled by immersing them in a water bath maintained at room temperature, about 25° C. Subsequent to air drying, the resulting toner was subjected to grinding in a 200AFG (Alpine Fluid Bed Grinder) enabling particles with a volume median diameter of from 8 to 12 microns as measured by a Coulter Counter. The 200 AFG grinder was operated with a 3 to 4 millimeter nozzle at 100 psig pressure. The grinder wheel speed was set to obtain desired particle size. The cubic shaped magnetite (MAPICO BLACK™, 200 nanometers primary particle size) preblended with TS-530 silica at 30 parts magnetite and 1 part silica was then continuously injected to the grind chamber at 9 weight percent of the grind rate during the size reduction process to yield a tightly bound uniform coverage of 9 weight percent magnetite on the toner surface. Thereafter, the aforementioned toner particles were classified in a Donaldson Model B classifier for the purpose of removing fine particles, that is those with a volume median diameter of less than about 4 microns. This toner (3 pound load) was subsequently blended with a small-sized external additive package consisting of 0.6 percent by weight of a surface-treated silica with an 8 nanometer particle size (TS-530 from Cabosil Corporation, with a surface treatment of hexamethyldisilazane and g-aminopropyl triethoxysilane), 0.8 percent by weight of a surface treated titania with a 16 nanometer particle size (MT-3103 from Tayca Corporation, with a surface treatment of decylsilane), 1.0 percent by weight of untreated titania with a 25 nanometer particle size P-25 from Degussa Chemicals), and 0.2 percent by weight of the film forming additive zinc stearate (obtained from Synpro Inc.). The conditions under which the additives were blended onto the surface were 2740 RPM for 2 minutes with 80° F jacket on a Henschel FM-10 blender. The presence of the magnetite on the surface was confirmed prior to the above blending of the silica, titania, and zinc stearate by scanning electron microscopy. The presence of the magnetite was reconfirmed after the silica, titania, and zinc stearate were blended onto the toner by the same method. That there was no loss of magnetite during the additive blending process was confirmed by pyrolysis of the toner and subsequent chemical identification of the magnetite.

Subsequently, the above formulated toner, 4 parts by weight, was mixed with 96 parts by weight of the carrier comprised of 99 percent by weight of an irregularly shaped steel core coated with 1 percent by weight of a Conductex SC Ultra conductive carbon black, obtained from Columbia Chemical./polymethylmethacrylate composite, and wherein mixing was accomplished in a paint shaker for 10 minutes. The composite contained about 20 percent of carbon black and 80 percent of the polymethylmethacrylate. There resulted on the toner composition, as determined in the known Faraday Cage apparatus, a positive triboelectric charge of $10^{-15}$ microcoulombs per gram.

The above prepared developer was aged using a bench roll mill technique to simulate xerographic developer housing aging. After 360 minutes of aging, which is equivalent to 60 minutes of aging in, for example, a Xerox Corporation 5090 xerographic developer housing without any toner throughput, the toner cohesion reached a value of 75 percent, significantly below the cohesion value of 92 percent reached under the same conditions for a toner with the identical formulation, but without the magnetite spacer.

EXAMPLE II

Black Developer Composition 2

There was prepared in an extrusion device, available as ZSK40 from Werner Pfleiderer, a toner composition by adding thereto 86 percent by weight of crosslinked polyester resin (33 to 40 percent gel), 5 percent of 660 P Sanyo polypropylene wax, 5 percent by weight of REGAL 330® carbon black, and 4 percent of AX-8840 compatibilizer, a block copolymer of ethylene glycidyl methacrylate. The toner product, which was extruded at a rate of 200 pounds per hour, reached a melting temperature of 160° C. The strands of melt mixed product exiting from the extruder were cooled by immersing them in a water bath maintained at room temperature, about 25° C. Subsequent to air drying, the resulting toner was subjected to grinding in a 200AFG (Alpine Fluid Bed Grinder) enabling particles with a volume median diameter of from 8 to 12 microns as measured by a Coulter Counter. The 200AFG grinder was operated with a 3 to 4 millimeter nozzle at 100 psig pressure. The grinder wheel speed was set to obtain desired particle size. A mixture of $Al_2O_3$ (Baikowski International, 150 nanometers size particles) preblended with TS-530 silica at 20 parts $Al_2O_3$ and 1 part silica was continuously injected to the grind chamber at 6 weight percent of grind rate during the size reduction process to yield a tightly bound uniform coverage of 6 weight percent $Al_2O_3$ particles on toner surface. Thereafter, the aforementioned toner particles were classified in a Donaldson Model B classifier for the purpose of removing fine particles, that is those with a volume median diameter of less than 4 microns. This toner (3 pound load) was subsequently blended with the same small-sized external additive package as Example I (0.6 percent TS-530, 0.8 percent MT-3103, 1.0 percent P–25, 0.2 percent ZnSt.) at 2,740 RPM for 2 minutes with 80° F. jacket on a Henschel FM-10 blender.

Subsequently, the above formulated toner, 4 parts by weight, was mixed with 96 parts by weight of the carrier composition (carrier was comprised of 99 percent by weight of an irregularly shaped steel core coated with 1 percent by weight of a Conductex SC Ultra conductive carbon black/poly(methylmethacrylate) composite), and wherein mixing was accomplished in a paint shaker for 10 minutes.

The developer was aged in the housing and showed only a small increase in percent cohesion with residence time in housing.

EXAMPLE III

Black Developer Composition 3

To the above parent toner compositions (Example I), a mixture of PMMA (polymethylmethacrylate) particles (SOKEN PMMA, 250 nanometers size particles) preblended with TS-530 silica at 13 parts PMMA and 1 part silica was continuously injected to the grind chamber at 4 weight percent of grind rate during the size reduction process to yield a tightly bound uniform coverage of 4 weight percent PMMA particles on the toner surface. Thereafter, the aforementioned toner particles were classified in a Donaldson Model B classifier for the purpose of removing fine particles, that is those with a volume median diameter of less than 4 microns. This toner (3 pound load) was subsequently blended with small-sized external additives (0.6 percent TS-530, 0.8 percent MT-3103, 1.0 percent P-25, 0.2 percent ZnSt.) at 2,740 RPM for 2 minutes with 80° F. jacket on a Henschel FM-10 blender.

Subsequently, the above formulated toner, 4 parts by weight, was mixed with 96 parts by weight of the carrier composition (carrier was comprised of 99 percent by weight of an irregularly shaped steel core coated with 1 percent by weight of a Conductex SC Ultra conductive carbon black/poly(methylmethacrylate) composite), and wherein mixing was accomplished in a paint shaker for 10 minutes.

The above developer was aged in a surrogate housing and showed an increase in cohesion to a value of less than about 65 percent, and more specifically, about 63 percent below the level necessary for stability in a xerographic development environment.

Other modifications of the present invention may occur to those skilled in the art subsequent to a review of the present application, and these modifications, including equivalents thereof, are intended to be included within the scope of the present invention.

What is claimed is:

1. A process for decreasing toner adhesion and decreasing toner cohesion, which comprises adding a component of magnetite, a metal, a metal oxide, a metal carbide, or a metal nitride to the surface of a toner comprised of resin, wax, and colorant, and wherein toner surface additives are blended with said toner, and wherein said component is permanently attached to the toner surface by the injection of said component in a fluid bed milling device during the size reduction process of said toner contained in said device, and where the power imparted to the toner to obtain said attachment is from equal to, or about above 5 watts per gram of toner.

2. A process in accordance with claim 1 wherein said component is magnetite, and is added in an amount of from about 1 to about 12 weight percent, the injection is continuous, and the colorant is a pigment.

3. A process in accordance with claim 1 wherein said power is from about 6 to about 15 watts per gram of toner, the injection is continuous, and the colorant is a pigment.

4. A process in accordance with claim 1 wherein said component is boron nitride, silicon carbide, silicon nitride, strontium titanate, tin oxide, barium titanate, magnesium titanate, barium zirconate, strontium zirconate, yttrium oxide, aluminum oxide, or aluminum nitride, and the toner surface additives are comprised of silica and titania.

5. A process for decreasing toner adhesion and decreasing toner cohesion, which comprises adding a component of magnetite to the surface of a toner comprised of resin, wax, and pigment, and wherein the magnetite is permanently attached to the toner surface by continuous injection of said magnetite additive in a fluid bed milling device during the size reduction process of the toner, and where the specific power imparted to the toner during said attachment process is equal to, or above about 5 watts per gram of toner.

6. A process in accordance with claim 5 wherein said power is from about 10 to 15 watts per gram of toner, and the injection is continuous.

7. A process in accordance with claim 5 wherein said magnetite is selected in an amount of from about 3 to about 9 weight percent.

8. A process in accordance with claim 5 wherein said magnetite is selected in an amount of from about 6 to about 9 weight percent.

9. A process in accordance with claim 5 wherein the toner further includes on the surface additives of silica, titania, and a zinc stearate film forming additive.

10. A process in accordance with claim 9 wherein each of said additives is selected in an amount of from about 0.1 to about 1 weight percent.

11. A process in accordance with claim 5 wherein said toner is substantially free of aging for about 500,000 imaging cycles in a xerographic imaging or printing apparatus.

12. A process in accordance with claim 6 wherein said toner is substantially free of aging for about 500,000 imaging cycles in a xerographic imaging or printing apparatus.

13. A process in accordance with claim 6 wherein said toner contains surface additives of silica and titanium oxide in an amount of from about 0.1 to about 0.75 weight percent.

14. A process in accordance with claim 5 wherein said resin is a polyester.

15. A process in accordance with claim 5 wherein said pigment is carbon black.

16. A process in accordance with claim 5 wherein said carbon black is present in an amount of from about 2 to about 12 weight percent.

17. A process which comprises adding a magnetite to a toner comprised of resin, colorant, wax, and surface additives, and wherein the magnetite is permanently attached to the toner surface by the continuous injection of said magnetite in a fluid bed milling device during the size reduction process of the toner contained in said device, and where the power imparted to the toner during said attachment is at least about 5 watts per gram of toner.

18. A process in accordance with claim 17 wherein said surface additives are comprised of fumed silica and metal oxides, each present in an amount of from about 0.1 to about 0.5 weight percent, said colorant is a pigment, and said power is from about 10 to about 15 watts.

19. A process in accordance with claim 17 wherein said resin is a styrene acrylate, a styrene methacrylate, a styrene butadiene, or a polyester; the wax is of a low molecular weight of from about 1,000 to about 20,000; and the wax is present in an amount of from about 3 to about 10 weight percent.

20. A process in accordance with claim 17 wherein said toner further contains a charge enhancing additive.

21. A process in accordance with claim 17 wherein said resin is present in an amount of from about 75 to about 95 weight percent, said pigment is present in an amount of from about 2 to about 12 weight percent, and said wax is present in an amount of from about 2 to about 5 weight percent.

22. A process in accordance with claim 17 wherein said toner is mixed with carrier particles.

23. A process in accordance with claim 22 wherein said carrier contains a coating thereover of a polyvinylidine fluoride, a polymethyl methacrylate, or a mixture of polymers not in close proximity in the triboelectric series.

24. A process which comprises adding a component of magnetite, a metal, a metal oxide, a metal carbide, or a metal nitride to the surface of a toner comprised of resin, wax, and colorant, and wherein said component is permanently attached to the toner surface.

* * * * *